US010930137B2

(12) United States Patent
Sun

(10) Patent No.: US 10,930,137 B2
(45) Date of Patent: Feb. 23, 2021

(54) EVENT ALARM DEVICE AND EVENT ALARM SYSTEM

(71) Applicant: Realtek Semiconductor Corp., HsinChu (TW)

(72) Inventor: Zaiqiang Sun, Shanghai (CN)

(73) Assignee: Realtek Semiconductor Corp., HsinChu (TW)

( * ) Notice: Subject to any disclaimer, the term of this patent is extended or adjusted under 35 U.S.C. 154(b) by 0 days.

(21) Appl. No.: 16/748,808

(22) Filed: Jan. 22, 2020

(65) Prior Publication Data

US 2020/0380853 A1 Dec. 3, 2020

(30) Foreign Application Priority Data

May 28, 2019 (CN) ..... 201910452367.X

(51) Int. Cl.

| | |
|---|---|
| ***G08B 25/10*** | (2006.01) |
| ***G08B 25/00*** | (2006.01) |
| ***G16Y 40/10*** | (2020.01) |
| ***G16Y 40/50*** | (2020.01) |

(52) U.S. Cl.

CPC ..... *G08B 25/10* (2013.01); *G08B 25/001* (2013.01); *G08B 25/004* (2013.01); *G16Y 40/10* (2020.01); *G16Y 40/50* (2020.01)

(58) Field of Classification Search

None

See application file for complete search history.

(56) References Cited

U.S. PATENT DOCUMENTS

| | | | | |
|---|---|---|---|---|
| 9,752,840 | B1 * | 9/2017 | Betro | F41A 17/06 |
| 2016/0042636 | A1 * | 2/2016 | Zhu | G08B 25/001 340/691.8 |
| 2019/0096202 | A1 * | 3/2019 | Seelman | G08B 29/188 |
| 2020/0213193 | A1 * | 7/2020 | Newell | H04W 48/08 |

FOREIGN PATENT DOCUMENTS

| | | | | |
|---|---|---|---|---|
| CN | 107888414 | A * | 4/2018 | |
| CN | 107948917 | A * | 4/2018 | |
| CN | 108833239 | A * | 11/2018 | |
| KR | 10-2019-0048866 | | 5/2019 | |
| WO | WO-2017142363 | A1 * | 8/2017 | H04W 8/08 |

* cited by examiner

*Primary Examiner* — Fekadeselassie Girma

(74) *Attorney, Agent, or Firm* — Winston Hsu

(57) ABSTRACT

An event alarm device includes a sensor, a notification unit, a MESH communication unit, an NB-IoT communication unit, and an MCU. The NB-IoT communication unit is configured to upload the data measured by the sensor. The MCU is configured to detect a specific event according to the data measured by the sensor. When detecting the specific event, the MCU is configured to instruct the notification unit to emit an on-site alarm, instruct the NB-IoT communication unit to send a first warning signal, and instruct the MESH communication unit to send a second warning signal.

3 Claims, 3 Drawing Sheets

EVENT ALARM DEVICE AND EVENT ALARM SYSTEM

CROSS REFERENCE TO RELATED APPLICATION

This application claims priority of China Application No. 201910452367.X filed on 2019 May 28.

BACKGROUND OF THE INVENTION

1. Field of the Invention

The present invention is related to an event alarm device and an event alarm system, and more particularly, to an event alarm device and an event alarm system which support both MESH and NB-IoT technologies.

2. Description of the Prior Art

Narrow Band-Internet of Things (NB-IoT) is a 3rd Generation Partnership Project (3GPP) standards-based low power wide area technology developed to enable a wide range of new IoT devices and can co-exist with existing 2G, 3G, and 4G mobile networks, thus benefiting from all the security and privacy features of these mobile networks. Common NB-IoT applications include smart metering (electricity, gas or water), intrusion/smoke detector for residential/commercial properties, environmental monitoring, smart city infrastructures, wearable equipment and medical equipment.

When a smoke detector implemented with NB-IoT technology detects smoke, a whistle alarm may be emitted. Meanwhile, the smoke detector may send short messages to designated cell phones, dial designated cell phone numbers, or inform designated cell phones installed with a specific APP using NB-IoT technology. A prior art NB-IoT smoke detector can alarm an individual or a single device. However, in a school or a shopping mall where many people are present or when the proprietor is absent from the fire location, the prior art NB-IoT smoke detector is unable to alarm all persons in the vicinity of a possible fire location. Also, the prior art NB-IoT smoke detector may operate in a power-saving mode (PSM) or an enhanced discontinuous reception (eDRX) mode for power saving purpose, in which the sensors are unable to send real-time alarms when detecting smoke.

SUMMARY OF THE INVENTION

The present invention provides an event alarm device which includes a sensor, a MESH communication unit, an NB-IoT communication unit configured to update data measured by the sensor, and a micro controller unit. The micro controller unit is configured to determine whether a specific event occurs according to the data measured by the sensor, instruct the NB-IoT communication unit to send a first warning signal when determining that the specific event has occurred, and instruct the MESH communication unit to send a second warning signal when determining that the specific event has occurred.

The present invention also provides an event alarm system which includes a first event alarm device and a second event alarm device. The first event alarm device includes a first sensor, a first MESH communication unit, a first NB-IoT communication unit configured to update data measured by the first sensor, and a first micro controller unit. The second event alarm device includes a second sensor, a second MESH communication unit, a second NB-IoT communication unit configured to update data measured by the second sensor, and a second micro controller unit. The second micro controller unit is configured to determine whether a specific event occurs according to the data measured by the second sensor, instruct the second NB-IoT communication unit to send a first warning signal when determining that the specific event has occurred, and instruct the second MESH communication unit to send a second warning signal to the first MESH communication unit when determining that the specific event has occurred.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
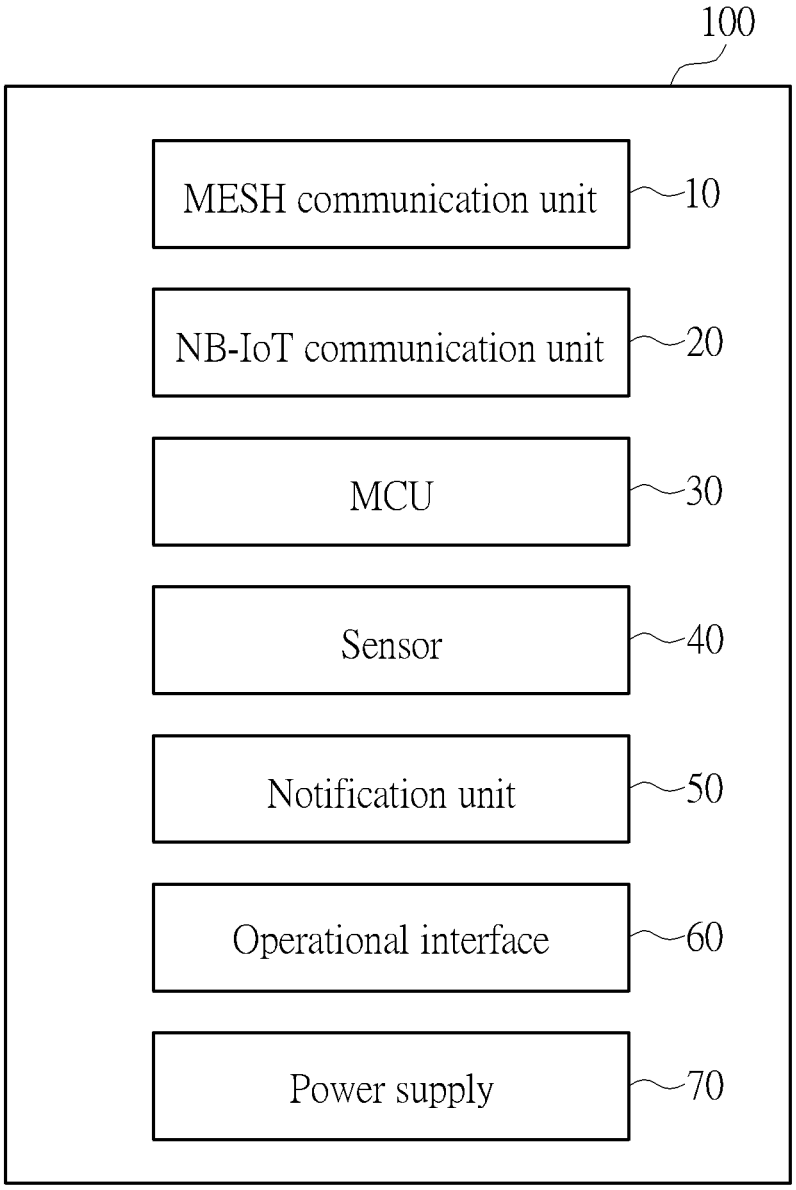
FIG. 1 is a functional diagram illustrating an event alarm device according to an embodiment of the present invention.

FIG. 1 is a functional diagram illustrating an event alarm device 100 according to an embodiment of the present invention. The event alarm device 100 includes a MESH communication unit 10, an NB-IoT communication unit 20, a micro controller unit (MCU) 30, a sensor 40, a notification unit 50, an operational interface 60, and a power supply 70.

Figure 2:
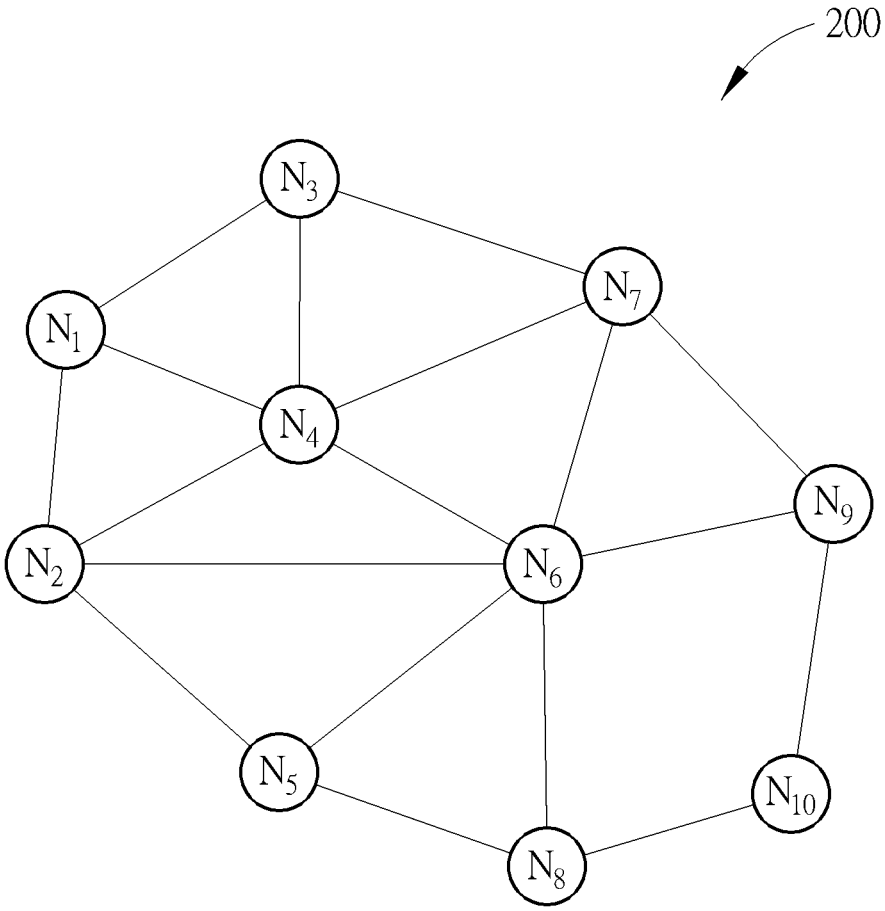
FIG. 2 is a diagram illustrating an event alarm system according to an embodiment of the present invention.

FIG. 2 is a diagram illustrating an event alarm system 200 according to an embodiment of the present invention. The event alarm system 200 includes a plurality of nodes $N_1$~$N_M$ (M is an integer larger than 1), each of which may be implemented using the event alarm device 100 in FIG. 1. Each of the plurality of nodes $N_1$~$N_M$ is configured to measure data at its location and inform other nodes using the MESH structure when detecting a specific event. Each of the nodes $N_1$~$N_M$ may serve as a data transmitting node, a data receiving node, or a data relay node. When a first node $N_1$ serving as a data transmitting node is located within the coverage range of a second node $N_2$ serving as a data receiving node, a wireless MESH link may be established between these two nodes for data communication. More specifically, the first node $N_1$ serving as a data transmitting node may transmit data to the second node $N_2$ serving as a data relay node, and the second node $N_2$ serving as a data transmitting node may transmit data to a third node $N_3$ serving as a data receiving node. For illustrative purpose, FIG. 2 depicts the embodiment when M=10. However, the amount of the nodes in the event alarm system 200 does not limit the scope of the present invention.

Figure 3:
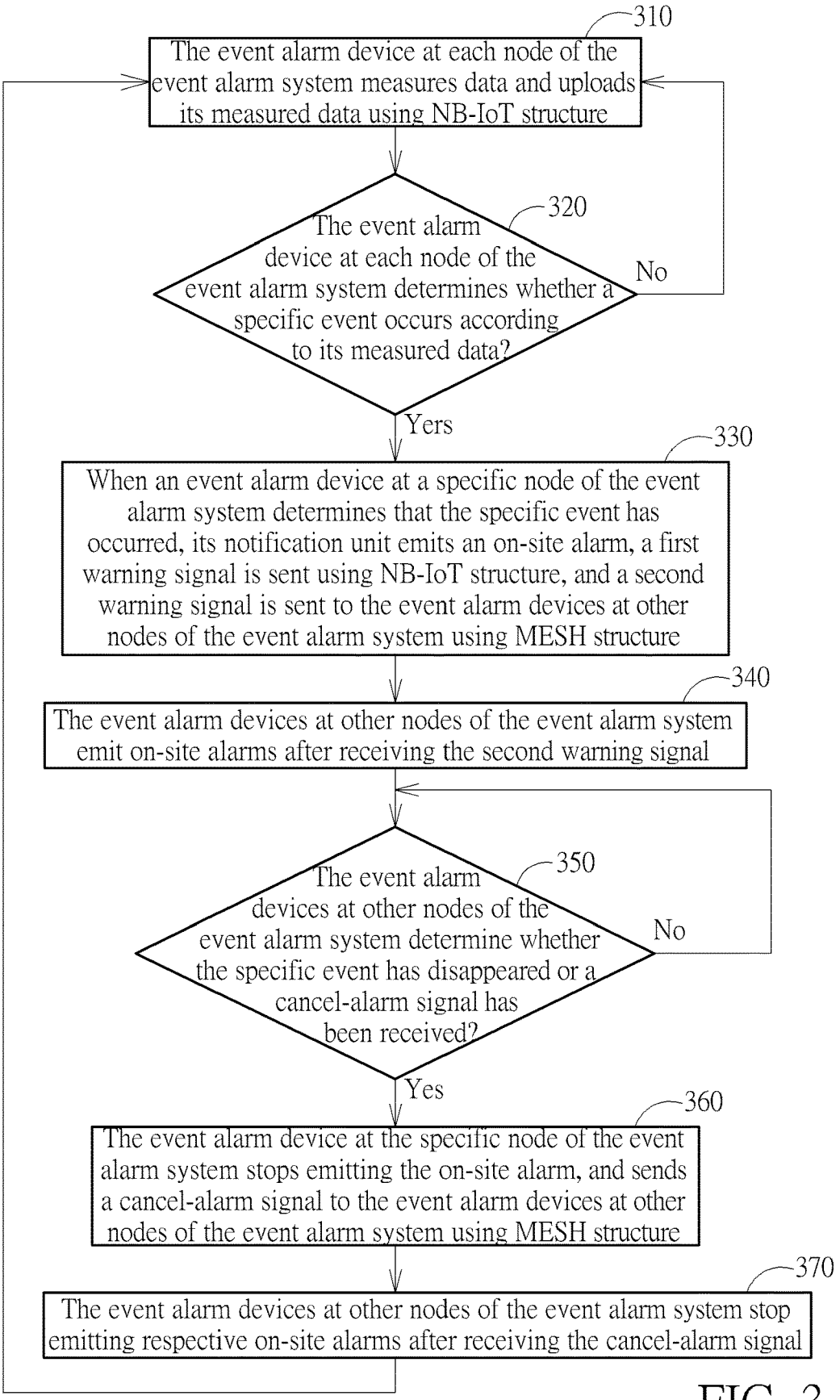
FIG. 3 is a flowchart illustrating the operation of an event alarm system according to an embodiment of the present invention.

FIG. 3 is a flowchart illustrating the operation of the event alarm system 200 according to an embodiment of the present invention. The flowchart in FIG. 3 includes the following steps:

Step 310: the event alarm device 100 at each node of the event alarm system 200 measures data and uploads its measured data using the NB-IoT structure; execute step 320.

Step 320: the event alarm device 100 at each node of the event alarm system 200 determines whether a specific event occurs according to its measured data; if yes, execute step 330; if no, execute step 310.

Step 330: when an event alarm device 100 at a specific node of the event alarm system 200 determines that the specific event has occurred, its notification unit 50 emits an on-site alarm, a first warning signal is sent using the NB-IoT structure, and a second warning signal is sent to the event alarm devices 100 at other nodes of the event alarm system 200 using the MESH structure; execute step 340.

Step 340: the event alarm devices 100 at other nodes of the event alarm system 200 emit on-site alarms after receiving the second warning signal; execute step 350.

Step 350: the event alarm devices 100 at other nodes of the event alarm system 200 determine whether the specific event has disappeared or a cancel-alarm signal has been received; if yes, execute step 360; if no, execute step 350.

Step 360: the event alarm device 100 at the specific node of the event alarm system 200 stops emitting the on-site alarm, and sends a cancel-alarm signal to the event alarm devices 100 at other nodes of the event alarm system 200 using the MESH structure; execute step 370.

Step 370: the event alarm devices 100 at other nodes of the event alarm system 200 stop emitting respective on-site alarms after receiving the cancel-alarm signal; execute step 310.

In step 310, the event alarm device 100 at each node of the event alarm system 200 is configured to measure data and upload its measured data using the NB-IoT structure. In an embodiment, the sensor 40 in each event alarm device 100 may measure the smoke, temperature, hazardous gas, or meteorological data (pressure, temperature, humidity, wind direction, wind speed, or precipitation) at its location. NB-IoT can be deployed in 3 different modes: in-band, guard-band or stand-alone, thereby co-existing with existing mobile networks for providing a low power wide area communication. Therefore, the event alarm device 100 at each node of the event alarm system 200 may periodically upload the data measured by its sensor 40 to the cloud, the server or another platform using its NB-IoT communication unit 20. However, the type of the sensor 40, the frequency of data upload, and the platform to which data is updated do not limit the scope of the present invention.

In step 320, the event alarm device 100 at each node of the event alarm system 200 is configured to determine whether the specific event occurs according to its measured data. In an embodiment, the specific event may be associated with a situation indicative of a possible danger, such as when the detected smoke concentration/particle size, the detected temperature or the detected hazardous gas concentration exceeds a predetermined value (indicating a possible fire), or when the detected meteorological data matches a predetermined condition (indicating a possible storm or a torrential rain) at its location. However, the type of the specific event does not limit the scope of the present invention.

In step 330, when the event alarm device 100 at the specific node of the event alarm system 200 determines that the specific event has occurred, its MCU 30 is configured to instruct the notification unit 50 to emit an on-site alarm, instruct the NB-IoT communication unit 20 to send the first warning signal to the cloud, the server or another platform (such as a cell phone, a computer or a landline telephone) which is connected to the specific node. Therefore, the personnel located at the specific node may be informed of a possible danger while achieving remote alarm using cell phone short messages, cell phone APPs, computer messages, or landline telephones. In an embodiment, the notification unit 50 may include a buzzer, an indicator light, and/or a screen, thereby capable of emitting the on-site alarm using sound, light, and/or text. However, the embodiment of the notification unit 50 does not limit the scope of the present invention.

Meanwhile, when the event alarm device 100 at the specific node of the event alarm system 200 determines that the specific event has occurred, its MCU 30 is configured to instruct the MESH communication unit 10 to send the second warning signal to the event alarm devices 100 at other nodes of the event alarm system 200 in step 330.

In step 340, when the event alarm devices 100 at other nodes of the event alarm system receive the second warning signal, their MCUs 60 are configured to instruct respective notification units 50 to emit on-site alarms. Furthermore, the location of the specific event may be shown on the screen of the notification unit 50. Therefore, the people located at other nodes of the event alarm system may be informed of a possible danger at the specific node, thereby evacuating to a safe place or handling the specific event.

In step 350, the event alarm devices 100 at other nodes of the event alarm system 200 are configured to determine whether the specific event has disappeared or a cancel-alarm signal has been received. In an embodiment, the personnel located at the specific node may handle the specific event when noticing the on-site alarm in step 330. Once the event alarm device 100 at the specific node of the event alarm system 200 determines that the specific event has disappeared, or the personnel located at the specific node manually issues the cancel-alarm signal after removing the cause of the specific event, its MCU 30 is configured to instruct the notification unit 50 to stop emitting the on-site alarm and instruct the MESH communication unit 10 to send the cancel-alarm signal to the event alarm devices 100 at other nodes of the event alarm system 200 in step 360, thereby informing the personnel located at other nodes of the event alarm system 200 that the threat of the specific event has been eliminated.

In another embodiment, after the event alarm device 100 at the specific node of the event alarm system 200 sends the first warning signal using the NB-IoT structure, the cloud, the server or another platform connected to the specific node may assign personnel to handle the specific event or activate a corresponding emergency procedure. Once the event alarm device 100 at the specific node of the event alarm system 200 determines that the specific event has disappeared, or the personnel assigned to the specific node manually issues the cancel-alarm signal after removing the cause of the specific event, its MCU 30 is configured to instruct the notification unit 50 to stop emitting the on-site alarm and instruct the MESH communication unit 10 to send the cancel-alarm signal to the event alarm devices 100 at other nodes of the event alarm system 200 in step 360, thereby informing the personnel located at other nodes of the event alarm system 200 that the threat of the specific event has been eliminated.

In another embodiment, when the event alarm device 100 at other nodes of the event alarm system 200 receive the second warning signal in step 340, the personnel located at other nodes may head for the specific node for handling the specific event. Once the event alarm device 100 at the specific node of the event alarm system 200 determines that the specific event has disappeared, or the personnel heading for the specific node manually issues the cancel-alarm signal after removing the cause of the specific event, its MCU 30 is configured to instruct the notification unit 50 to stop emitting the on-site alarm and instruct the MESH communication unit 10 to send the cancel-alarm signal to the event alarm devices 100 at other nodes of the event alarm system 200 in step 360, thereby informing the personnel located at other nodes of the event alarm system 200 that the threat of the specific event has been eliminated.

In conclusion, the present invention provides an event alarm system which includes a plurality of nodes. Each node may be implemented by an even alarm device which supports both the MESH technology and the NB-IoT technology. When an event alarm device at a specific node of the event alarm system determines that a specific event has occurred, anon-site alarm is emitted, a first warning signal is sent to a specific platform using the NB-IoT structure, and a second warning signal is sent to the event alarm devices at other nodes of the event alarm system using the MESH structure. Therefore, the event alarm system of the present invention may achieve on-site alarm and remote alarm using cell phone short messages, cell phone APPs, computer messages, or landline telephones.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An event alarm system, comprising:

a first event alarm device, comprising:

a first sensor;

a first MESH communication unit;

a first NB-IoT communication unit configured to update data measured by the first sensor;

a first micro controller unit; and a second event alarm device, comprising:

a second sensor;

a second MESH communication unit;

a second NB-IoT communication unit configured to update data measured by the second sensor;

a second micro controller unit configured to:

determine whether a specific event occurs according to the data measured by the second sensor;

instruct the second NB-IoT communication unit to send a first warning signal when determining that the specific event has occurred;

instruct the second MESH communication unit to send a second warning signal to the first MESH communication unit when determining that the specific event has occurred;

determine whether the specific event has disappeared according to the data measured by the second sensor; and instruct the second MESH communication unit to send a cancel-alarm signal to the first MESH communication unit when determining that the specific event has disappeared.

2. The event alarm system of claim 1, wherein the first micro controller unit is further configured to:

instruct the first notification unit to emit a first on-site alarm when the first MESH communication unit receives the second warning signal; and instruct the first notification unit to stop emitting the first on-site alarm when the first MESH communication unit receives the cancel-alarm signal.

3. The event alarm system of claim 1, wherein the micro controller unit is further configured to instruct a second notification unit to emit a second on-site alarm when determining that the specific event has occurred.

* * * * *